US005448062A

United States Patent [19]

Cooks et al.

[11] Patent Number: 5,448,062

[45] Date of Patent: Sep. 5, 1995

[54] ANALYTE SEPARATION PROCESS AND APPARATUS

[75] Inventors: Robert G. Cooks; Scott J. Bauer, both of West Lafayette, Ind.

[73] Assignee: MIMS Technology Development Co., West Lafayette, Ind.

[21] Appl. No.: 113,844

[22] Filed: Aug. 30, 1993

[51] Int. Cl.[6] ..... H01J 49/04

[52] U.S. Cl. ..... 250/288; 73/863.23; 73/864.81

[58] Field of Search ..... 250/288, 288 A; 73/863.23, 864.81

[56] References Cited

U.S. PATENT DOCUMENTS 4,791,292 12/1988 Cooks et al. ..... 250/288
4,883,958 11/1989 Vestal ..... 250/288 A

OTHER PUBLICATIONS

Hoch et al., "A Mass Spectrometer Inlet System for Sampling Gases Dissolved in Liquid Phases", *Arch. of Biochem. BIophys.*, vol. 101, pp. 160–170 (1963).

Bier et al., "Membrane Interface for Selective Introduction of Volatile Compounds Directly Into the Ionization Chamber of a Mass Spectrometer", *Anal. Chem.*, vol. 59, pp. 597–601 (1987).

Slivon et al., "Helium-Purged Hollow Fiber Membrane Mass Spectrometer Interface for Continuous Measurement of Organic Compounds in Water", *Anal. Chem.*, vol. 63, pp. 1335–1340 (1991).

Bauer et al., "Performance of an Ion Trap Mass Spectrometer Modified to Accept a Direct Insertion Membrane Probe in Analysis of Low Level Pollutants in Water", *Talanta,* vol. 40, pp. 1031–1039 (1993).

Stern et al., "Separation of Gas Mixtures in a Supersonic Jet. II. Behavior of Helium-Argon Mixtures and Evidence of Shock Separation", *J. Chem. Phys.*, vol. 33, pp. 805–813 (1960).

Lauritsen et al., "Microporous Membrane Introduction Mass Spectrometry with Solvent Chemical Ionization and Glow Discharge for the Direct Detection of Volatile Organic Compounds in Aqueous Solution", *Anal. Chim. Acta,* vol. 266, pp. 1–12 (1992).

Lauritsen et al., "Direct Detection and Identification of Volatile Organic Compounds Dissolved in Organic Solvents by Reversed-Phase Membrane Introduction Tandem Mass Spectrometry", *Anal. Chem.*, vol. 64, pp. 1205–1211 (1992).

*Primary Examiner*—Jack I. Berman
*Attorney, Agent, or Firm*—Woodard, Emhardt, Naughton, Moriarty & McNett

[57] ABSTRACT

Described are preferred processes and apparatuses for treating samples so as to form conditioned samples for analysis, such as by a mass spectrometer. The apparatuses and processes of the invention include the use of both a membrane separator and a jet separator. This combination of separation techniques results in dramatic and unexpected increases in detection limits.

14 Claims, 16 Drawing Sheets

ANALYTE SEPARATION PROCESS AND APPARATUS

BACKGROUND OF THE INVENTION

The present invention resides generally in the field of techniques for quantifying analytes in liquid samples. More particularly, the invention relates to a process and an apparatus for treating a liquid sample to separate and concentrate an analyte, for example for introduction into a device for generating a signal relative to the concentration of the analyte.

As further background to the invention, membranes has long been studied as a sample interface for mass spectrometers. The first example of this type of technology was described by G. Hoch and B. Kok, *Arch. of Biochem, and Biophys.* 101 (1963) 171. Configuration changes in the membrane inlet design over time gradually increased the sensitivity of the technique with the most dramatic results being obtained through the use of the direct insertion membrane probe which positioned the membrane in the mass spectrometer source (M. Bier et al., Anal. Chem. 59 (1987) 597; R. G. Cooks et al., U.S. Pat. No. 4,791,292 (1989)). Membrane configuration where the membrane was located remote the mass spectrometer source remained problematic and was plagued by poor reproducibility and memory effects.

One of the most successful remote membrane designs was described by Slivon et al., *Anal, Chem.* 63 (1991) 1335. In this configuration the capillary silicone membrane was placed in a tubular chamber an the liquid sample flowed across the outside of the membrane. Analytes crossed the membrane by a process of pervaporation to the internal diameter where they drifted into the mass spectrometer source for analysis. Although reasonably good detection limits were obtainable, Slivon's design still suffered from some of the previous problems such as poor reproducibility.

Jet separator devices were originally designed as an interface between a gas chromatograph and a mass spectrometer. Early on in gas chromatography/mass spectrometry (GC/MS), packed chromatography columns were used. A typical packed column included a $\frac{1}{8}''$ diameter glass or stainless steal tube of variable length packed with a solid stationary phase. The gaseous sample passed through the column in a carrier stream which was typically hydrogen, helium or nitrogen. The problem of interfacing a mass spectrometer to a gas chromatograph was that the carrier gas stream volume was too high for the mass spectrometer to handle. A means of removing the excess carrier gas was required to provide an effective interface. Many devices were designed for this purpose, but the most successful was the jet separator. Generally, a jet separator includes a pair of needle jets separated by a small gap in an evacuated chamber. The heavier analyte molecules pass across the gap and continue into the mass spectrometer while the lighter carrier gas molecules that have less momentum are pumped away at the gap.

In light of the background in this area and the constant need to improve detection limits in analytical equipment such as mass spectrometers, there is a continued demand for improved processes and apparatuses for conditioning samples to concentrate analytes of interest for analysis. The present invention addresses this need.

SUMMARY OF THE INVENTION

Accordingly, briefly describing one preferred embodiment of the invention, there is provided a device for treating a sample for introduction into a mass spectrometer. The device comprises a membrane separator device adapted to treat a crude analyte-containing sample to form a first conditioned sample enriched in the analyte relative to the crude sample. The device further comprises a let separator device fluidly coupled to the membrane separator to receive said first conditioned sample, and adapted to treat the first conditioned sample to form a second conditioned sample enriched in the analyte relative to the first conditioned sample.

Another preferred embodiment of the invention provides a method for treating a rude analyte-containing sample for introduction into a mass spectrometer. The method comprises treating the crude sample with a membrane separator device so as to form a first conditioned sample enriched in the analyte relative to the crude sample The method further comprises treating the first conditioned sample with a jet separator device so as to form a second conditioned sample enriched in the analyte relative to the first conditioned sample.

Another preferred embodiment of the invention provides an analytical apparatus. The apparatus comprises a membrane separator device adapted to treat a crude analyte-containing sample to form a first conditioned sample enriched in the analyte relative to the crude sample. The apparatus further includes a jet separator device fluidly coupled to the membrane separator to receive said first conditioned sample, and adapted to treat the first conditioned sample to form a second conditioned sample enriched in the analyte relative to the first conditioned sample, and, a mass spectrometer having a sample input fluidly coupled to said jet separator device so as to receive said second conditioned sample for analysis.

Still another preferred embodiment of the invention provides a device for treating a crude sample having an analyte contained in a liquid. The device includes a membrane separator device comprising a membrane against which the sample can be passed so as to selectively pass the analyte through the membrane and thus create a first conditioned sample enriched in the analyte relative to the crude sample. The device also includes a jet separator device comprising a sample delivery tube and a sample receiving tube separated by a gap and housed within a chamber adapted to be evacuated, said sample delivery tube being fluidly coupled to said membrane separator to receive said first conditioned sample, so that passage of said first conditioned sample through said delivery tube, across said gap and into said receiving tube forms a second conditioned sample enriched in the analyte relative to the first sample.

The present invention provides processes and apparatuses which enable improved low detection limits for analytes by mass spectrometry and similar analytical techniques. Devices and processes of the invention can be readily and inexpensively manufactured and performed. Additionally, under typical operating conditions, high sample processing rates (10–20 samples per hour) are possible using inventive processes and apparatuses while multicomponent analysis of aqueous solutions without sample pretreatment is achieved. Additionally, response time using processes and apparatuses of the invention is short and no prior sample preparation is needed. Moreover, apparatuses of the invention provide ready access to the membrane. Additional objects, features, advantages and embodiments of the invention will be apparent from the following description.

DESCRIPTION OF THE PREFERRED EMBODIMENT

Figure 1:
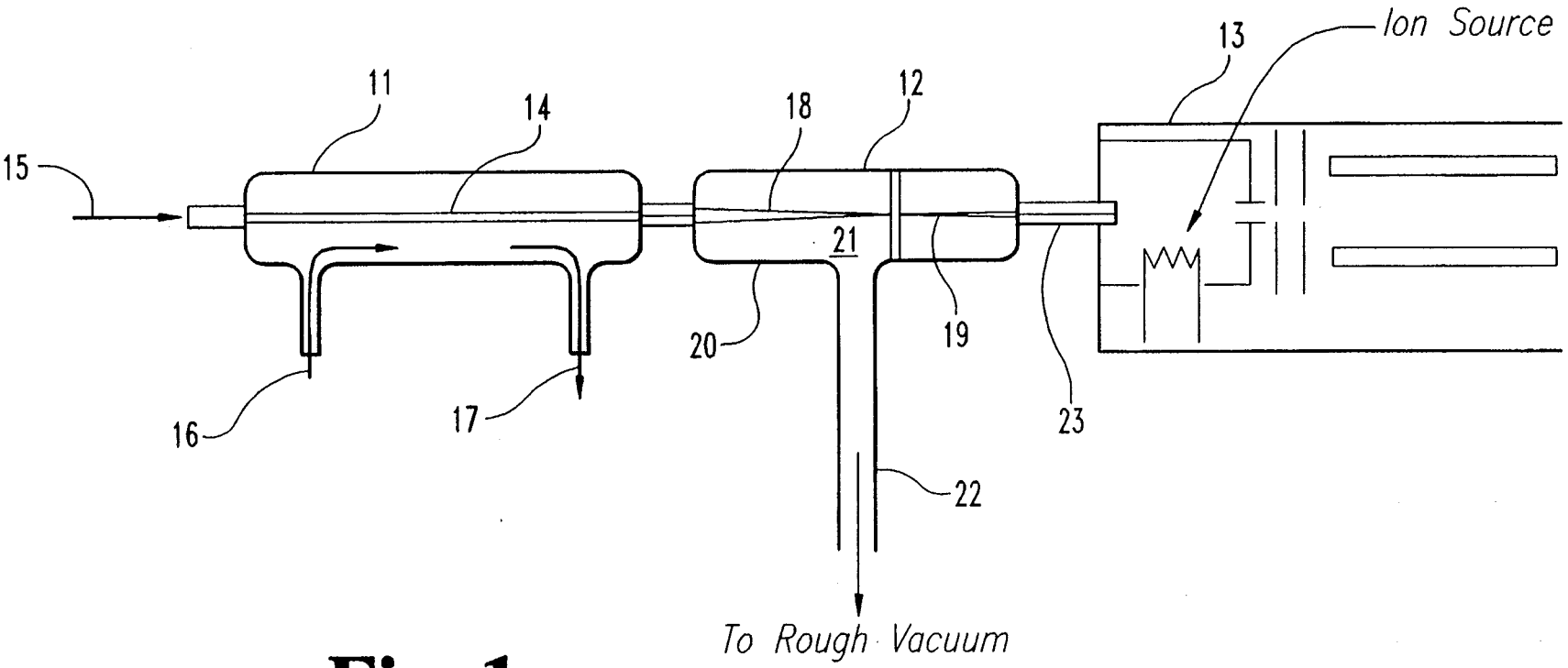
FIG. 1 is a schematic diagram of a capillary membrane/jet separator mass spectrometer inlet apparatus of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Generally, the invention provides a device and process for treating a sample, for example an aqueous sample containing a volatile organic compound, so as to form a conditioned sample enriched in the organic compound. By the invention, the direct detection of organic compounds present in samples is enabled to the parts per trillion range.

In accordance with the invention, the sample (herein referred to as the "crude sample" for purposes of convenience only) is enriched in two consecutive stages, one utilizing a membrane (semi-permeable or microporous) interface and the other a jet separator. The crude sample is sampled as it flows over a first side of the membrane, while the other side is continuously purged by an inert gas such as helium. The permeate through the membrane is pneumatically transported to the mass spectrometer via a jet separator which serves to remove excess inert gas and water from the analyte vapor stream.

Referring now to FIG. 1, shown is a schematic diagram of an apparatus of the invention including a membrane separator 11, a jet separator 12 and a mass spectrometer 13. Generally, a membrane separator is a device incorporating a membrane in which one side of the membrane is exposed to a liquid sample and the other side, in use, is expose to a vacuum source such as that of a mass spectrometer. The membrane separator functions to exclude unwanted components of the liquid sample from entering the vacuum area or, in other words, to selectively transport components of interest (e.g. analytes) into the vacuum area to the exclusion of others. A jet separator, in general terms, is a device including a sample delivery orifice and a sample receiving orifice (e.g. each provided by a small-bore capillary tube) separated by a small gap in an evacuated chamber. Sample is passed at high velocity out of the delivery orifice. The heavier analyte molecules pass across the gap and continue into the receiving orifice (and into the mass spectrometer) while lighter molecules that have less momentum, such as carrier gas, are pumped away at the gap. For additional information relative to jet separators, reference can be made to literature on the subject including for example U.S. Pat. Nos. 3,957,470, 3,936,374, and 5,137,553.

Referring more specifically to FIG. 1, membrane separator 11 is a coaxial membrane apparatus, employing tubular membrane 14 formed from a suitable semipermeable or microporous material, for example a silicon polymer (e.g. Silastic) membrane or a nafion membrane. Silicon polymer membranes are preferred for analysis of relatively non-polar low molecular weight non-volatile organics, whereas microporous sheet membranes are preferred for high molecular weight compounds and those of higher polarity, or in cases where organic analytes are to be detected in organic matrices. The internal cannula of membrane 14 is fluidly connected to inlet 15 into which helium or another inert gas is passed. Separator 11 further includes crude sample inlet 16 and outlet 17 into and out of which crude sample is passed, respectively (the inlet and outlet can be reversed if desired, to provide a sample flow that is countercurrent to the flow of the inert gas). As crude sample passes through separator 11 and against the outer surfaces of membrane 14, it is sampled so as to form a first conditioned sample occurring on the interior of tubular membrane 14 and which is enriched in the analyte of interest.

Jet separator device 12, which can be metal, quartz or glass, is fluidly connected to membrane separator 11 so as to receive the first conditioned sample. Jet separator 12 includes a sample delivery capillary 18 such as a needle and a sample receiving capillary 19 such as a needle, separated by a gap as illustrated. Jet separator 12 also includes housing 20 forming chamber 21 adapted to be evacuated, for example by the application of vacuum to chamber 21 via vacuum tube 22. The first conditioned sample from membrane separator 11 is carried into jet separator 12 by the inert gas passing therethrough. As this analyte-containing vapor exits delivery capillary 18, excess helium and water are removed through vacuum tube 22. As a result, a second conditioned sample, which is further enriched in the analyte, enters sample receiving capillary 19. This second conditioned sample then passes through tube 23 fluidly connected to the sample input of mass spectrometer 13 where it is conventionally analyzed.

Figure 2:
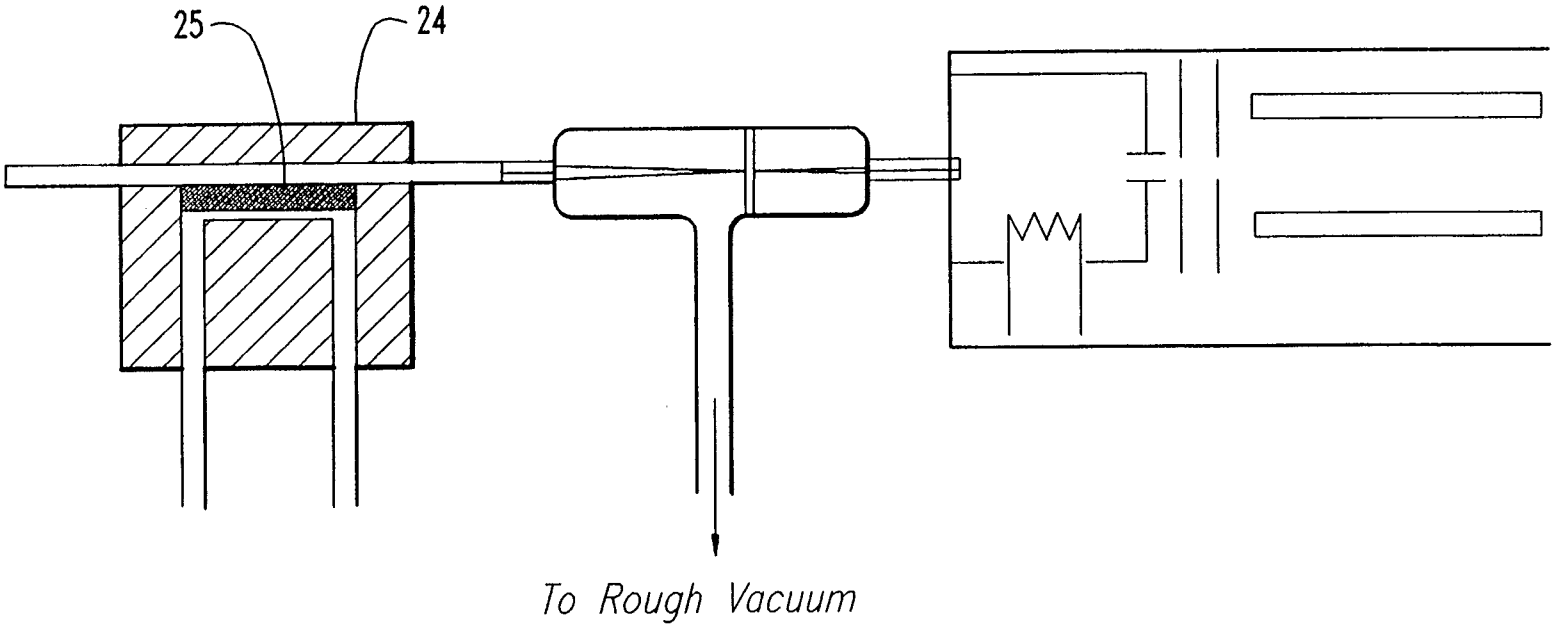
FIG. 2 is a schematic diagram of a sheet membrane/-jet separator mass spectrometer inlet apparatus of the invention.

Referring now to FIG. 2, shown is another apparatus of the invention. This apparatus is similar to the apparatus illustrated in FIG. 1, except it includes a membrane separator 24 including a sheet membrane 25 instead of a tubular membrane (14 in FIG. 1). When using sheet membrane 25, crude sample is simply passed against one side of the membrane while the inert gas is passed over the other. The permeate forms the first conditioned sample, which is then carried into and processed by the jet separator as in the apparatus of FIG. 1.

Figure 3:
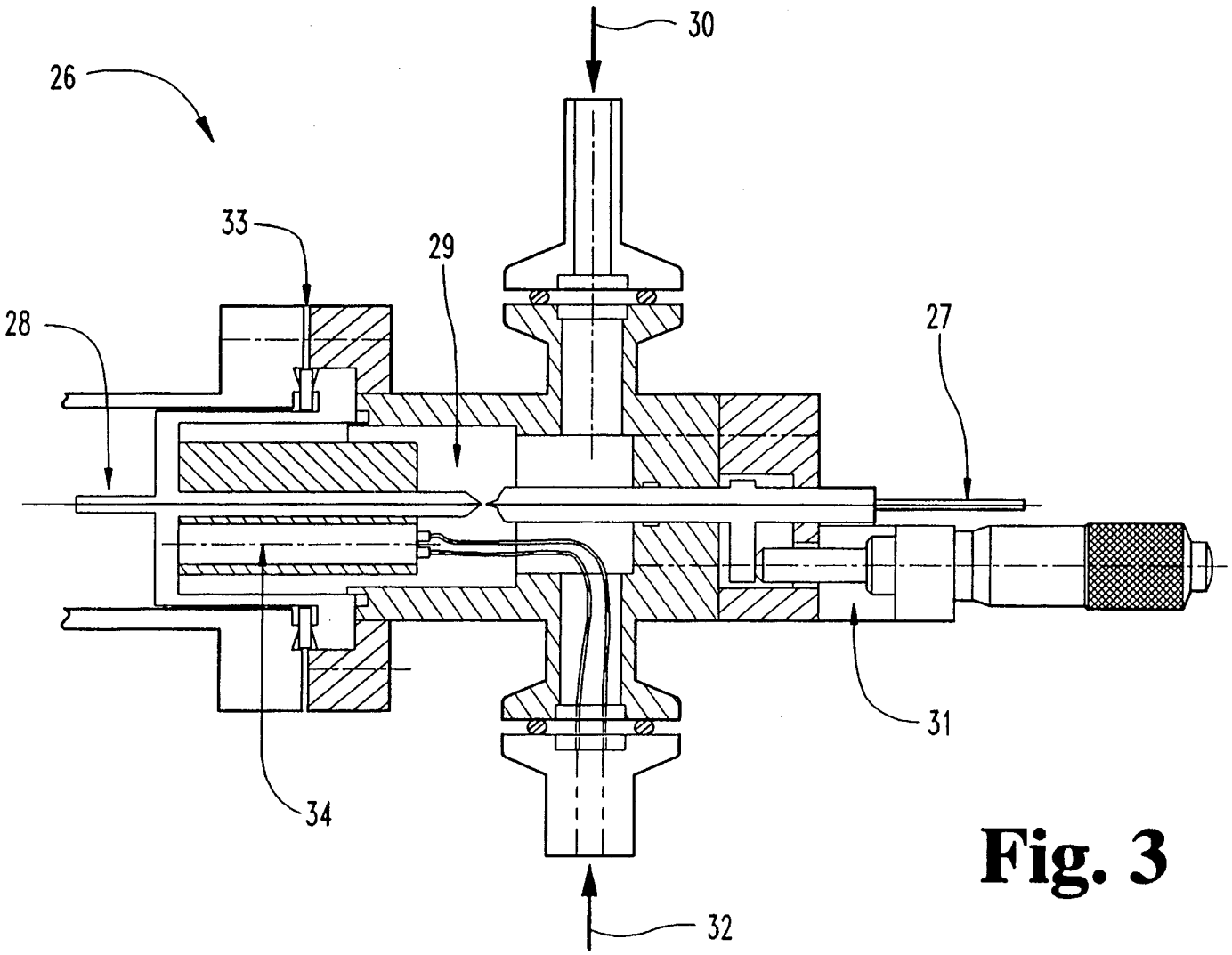
FIG. 3 is a schematic diagram of a heated, gap-adjustable jet separator which can be used in apparatuses of the invention.

In accordance with the invention, the jet separator used can optionally be heated to minimize analyte and water condensation, and the gap between the delivery and receiving capillaries can optionally be variable. Although jet separators currently commercially available can be suitably used in the invention, it has been found that water removal is optimized and detection limits are lowered at jet tip spacing greater than those in current commercial devices. Referring now to FIG. 3, shown is a schematic diagram of a heated jet separator 26 incorporating means for varying the jet tip spacing. Jet separator 26 generally also includes the operational features as described in connection with FIG. 1. Thus, jet separator 26 includes capillary 27 connected to the output of the membrane separator, capillary 28 connected to the mass spectrometer source, expansion chamber 29, tube 30 connected to a source of vacuum (e.g. a rough pump), micrometer screw 31 which can be used to vary the gap, electrical feed through 32, high vacuum flange 33 (e.g. a 70 mm Conflat high vacuum flange) which can be included to fit the device to a mass spectrometer, and heater element 34. This advantageous arrangement enables the variation of operational parameters to alter and improve results, as detailed in the Experimental below.

Surprisingly, in mass spectrometry, it has been discovered that a jet separator, when used in conjunction with an upstream membrane separator, not only removes excess water from the sample (thus decreasing background interference) but also results in an unexpected increase in the analyte signal. For example, in some instances the analyte signal is increased on the order of 100 times or more as compared to analogous runs using a membrane separator alone. This highlights the dramatic nature of the applicant's discoveries, and greatly improves the capacity of existing mass spectrometry equipment to detect organic analytes at low levels.

For the purpose of promoting a further understanding of the invention and its features and advantages, the following specific experimental is provided. It will be understood that this experimental is illustrative, and not limiting, in nature.

EXPERIMENTAL

Two mass spectrometers were used in this work. One is a Finnigan ITS40 GC/MS quadrupole ion trap which was fitted with (i) a direct insertion membrane probe, (ii) a membrane/jet separator system and (iii) both interfaces. The second instrument, a Balzers QMG 420 single quadrupole mass spectrometer, was fitted with a membrane/jet separator. Details of each system follow.

A. Quadrupole Ion Trap

Membrane Probe

In these experiments, the sample was provided via a capillary direct insertion membrane probe as described by Bauer, S. J. and Cooks, R. G., *Talanta,* 1993, 40, 1031 fitted with a 1.5 cm silastic hollow fiber membrane (0.635 mm ID × 1.19 mm OD, Dow Corning). The temperature of the membrane was normally set at 30° C. using a programmable heater incorporated into the casing of the probe and controlled by a Finnigan solids probe programmable temperature controller. Sample solutions were pumped through the probe at a flow rate of 2 ml/min using a peristaltic pump located downstream from the membrane to avoid adding traces of leachates from the pump to the sample stream.

Membrane/Jet Separator

Figure 4:
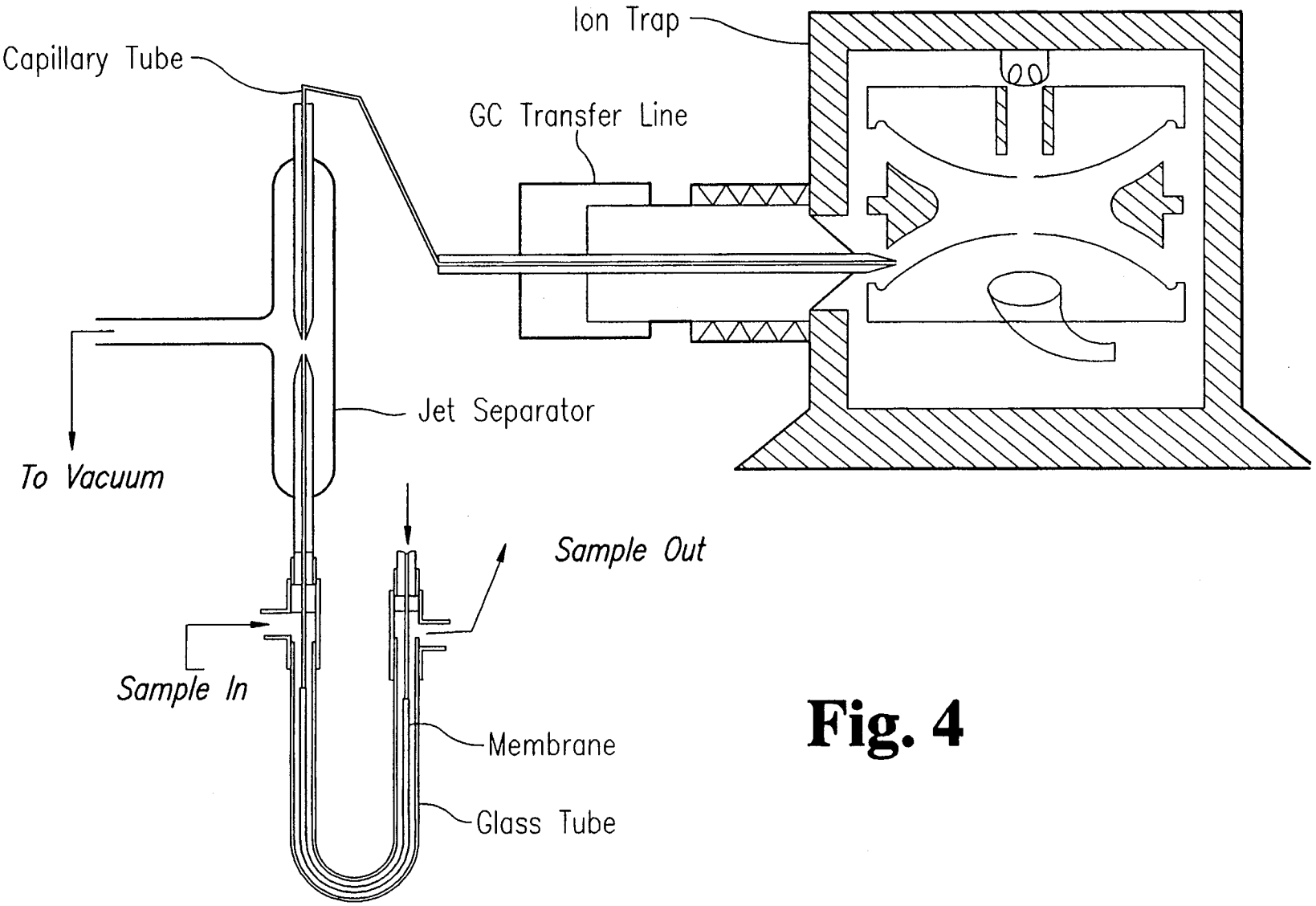
FIG. 4 is a schematic diagram of a membrane/quartz jet separator interfaced to a GC/MS ion trap mass spectrometer, as further described in the Experimental.

In these experiments r the membrane of membrane separator was a Silastic hollow fiber membrane (0.635 mm ID × 1.19 mm OD, 15 cm long in most experiments, Dow Corning), encased in a 2 mm ID pyrex tube in the coaxial arrangement such as in FIG. 4. The membrane was soaked in n-hexane prior to insertion into the assembly. The coaxial assembly was connected to a quartz jet separator (SGE, Part No. 113506) which was pumped by a mechanical vacuum pump (Alcatel, Model M2008A) in order to remove helium and water from the analyte stream. The helium flow rate was controlled using the GC variable gas flow controller of the Finnigan ITS40 GC/MS. A typical helium purge pressure setting was 0.068 bar. Higher helium pressure resulted in formation of bubbles on the external side of the membrane due to permeation of helium This reduced the effective membrane surface. The membrane was operated at ambient temperature and care was taken to avoid passage of air; water was passed when analyte was not flowing.

The jet separator interface was connected to the ion trap via a 51 cm stainless steel tube (1.588 mm OD×0.762 mm ID) inserted through the GC transfer line and sealed by a Teflon front ferrule. The schematic diagram in FIG. 4 shows the membrane/jet separator ion trap mass spectrometer system. Aqueous samples were passed through the glass tube containing the membrane using a peristaltic pump located downstream from the membrane. The direction of flow of the aqueous solution was opposite to the flow of the helium purge gas. The permeates were swept into the jet separator where most of the helium and some of the water were removed, and then passed into the mass spectrometer via the GC transfer line.

Ion Trap (ITS40 GC/MS, Finnigan) The modifications to the ion trap to accommodate a direct insertion membrane probe have been previously described. Bauer, S. J. and Cooks, R. G., *Talanta,* 1993, 40, 1031. These modifications place the membrane a short distance from the ion trap electrodes. The membrane probe can be inserted and operated at the same time as the membrane/jet separator, allowing the relative performance of the two membrane systems to be evaluated under identical operating conditions.

Standard ion trap operating conditions used electron impact ionization with a filament current of 80 μA and a manifold temperature of 50° C. The ionization time was 25 mseconds. The helium buffer gas needed for the proper operation of the ion trap was admitted through the chemical ionization (CI) gas line equipped with a modified solenoid control, while the helium gas for the membrane was supplied from a separate helium gas tank. For the membrane/jet separator system, the buffer gas through the CI gas line was completely turned off and only the helium through the membrane was used. Data were typically acquired by scanning over the range 50 to 250 Da/charge at 2 seconds/scan. The automatic gain control function of the ion trap was used in all experiments.

Sample Preparation

Aqueous solutions of volatile organic compounds were prepared by serial dilution of commercially available reagents using deionized water. The data in Table I were taken for mixtures of the analytes purchased as such from ChemService (Avondale, Pa.). Samples were introduced into the coaxial membrane probe assembly at a rate of 30 mL/min although lower flow rates were used for some experiments. Experiments were done at room temperature and the mass spectra shown include background subtraction.

B. Single Quadrupole

Membrane/Jet Separator

The membrane/jet separator used with the quadrupole mass spectrometer consists of a 15 cm Dow Corning silastic hollow fiber membrane (0.635 mm ID×1.19 mm OD) encased in a glass tube (2 mm ID) and connected to a custom-built stainless steel jet separator. Unlike the commercial quartz separator used ambient temperature on the ion trap, provisions were made to operate the membrane and the jet separator at elevated temperatures. The jet separator (FIG. 3) was constructed on a standard 70 mm Conflat flange. The separator tips were made of two precisely aligned stainless steel capillaries; the internal diameter of the delivery capillary (connected to HE purge) was 0.128 mm and that of the receiving capillary was 0.256 mm. The delivery capillary can be positioned by a calibrated micrometer screw making the gap between the two tips adjustable within an accuracy of 5 microns. The expansion chamber was pumped using a rotary pump and the pressure, measured with a Pirani Gauge, was typically 1 mbar. The receiving capillary was 5 cm long and directly connected to the ion source. The pressure was $4\times10^{-5}$ mbar helium in the mass spectrometer. The entire jet separator block was encased in an electrically heated copper block with the capability of maintaining separator temperatures up to 150° C. However, no heating of the jet separator was used in the described experiments.

Quadrupole Mass Spectrometer (QMG 420, Balzers, Liechtenstein).

This instrument employs a closed electron impact ion source operated at 70 eV. An off-axis multiplier was used in the detection limit experiments, while an on-line Faraday cup allowed the signal due to ionized helium to be measured at the same time as the analyte. The total pressure in the mass spectrometer was measured by a Penning gauge (IKR 020, Balzers, Liechtenstein) and was typically $4\times10^{-5}$ mbar.

Other Conditions

Detection limits were measured using solution prepared by serial dilution of commercially available reagents. The samples were passed through the membrane inlet at a rate of 5 mL/min as 10–50 mL plugs in distilled water, the sample size depending on the response time of the particular compound measured. In all experiments, the temperature of the sample solution was equilibrated at 45° C. prior to passage through the membrane inlet. Mass spectra of the extremely low concentration solutions were recorded using background subtraction but otherwise this was not necessary.

RESULTS

A. Ion Trap

Direct Insertion Membrane Probe (DIMP)

Figure 5:
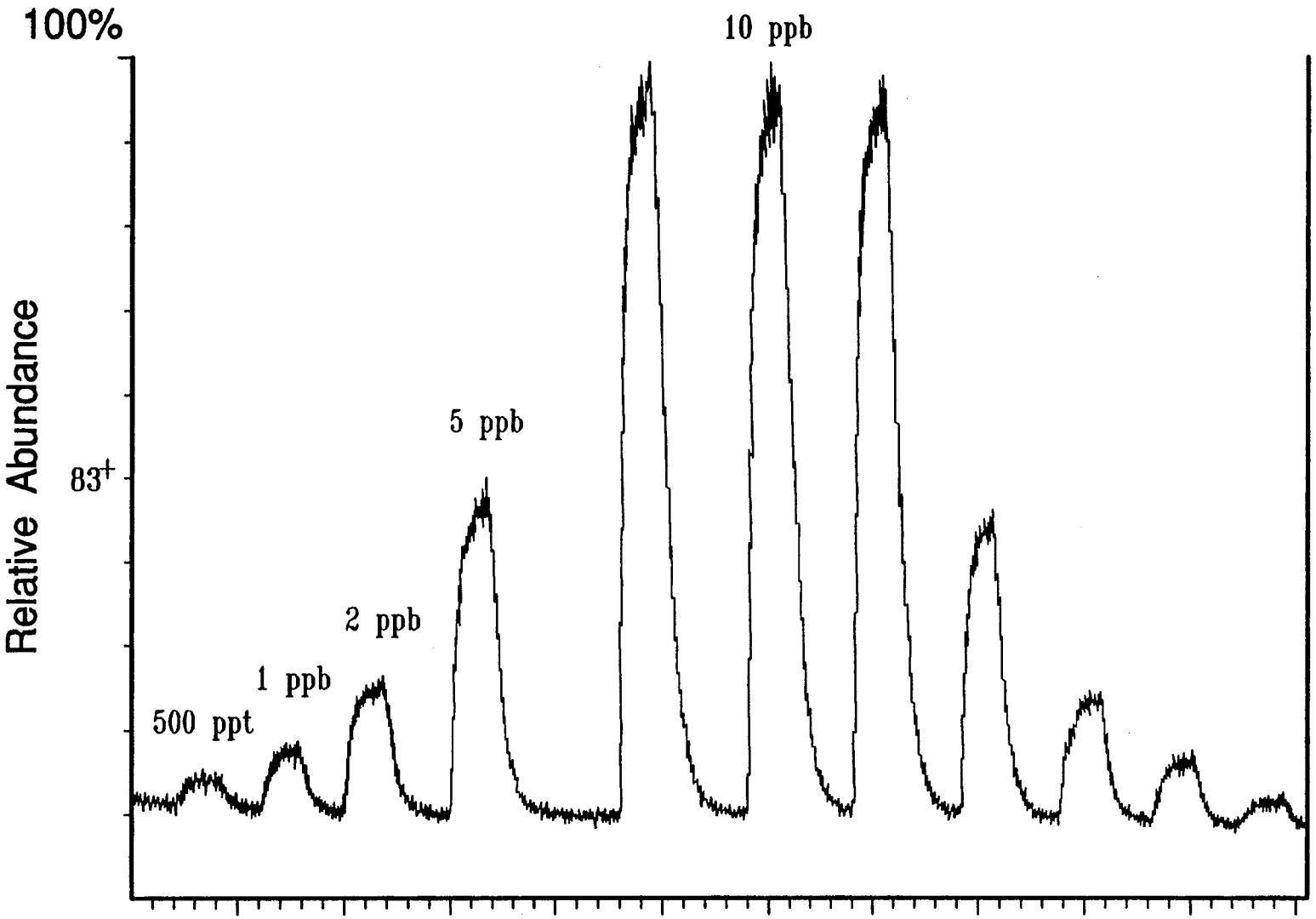
FIG. 5 is an ion chromatogram (m/z 83) for aqueous solutions of chloroform at 0.5, 1, 2, 5, and 10 ppb levels. The chromatogram was developed by injecting the solutions sequentially into a direct membrane insertion probe (fitted to a quadrupole ion trap mass spectrometer) in ascending and descending order of concentrations, as further described in the Experimental. The quantitative reproducibility of the data is reflected in the signal intensity for each solution.

As mentioned above, the membrane probe/ion trap combination has been described previously together with some examples of its performance characteristics. To provide a basis for comparison with the MIMS jet separator method, twenty eight volatile organic compounds, in aqueous solution, were analyzed using the membrane probe fitted to the ion trap mass spectrometer. The compounds were examined as mixtures (supplied by ChemService) which are intended to cover many of the analytes of interest in US EPA method 624. Results are given in Table I. All of the compounds exhibit detection limits less than or equal to 2 ppb. Note that the data can also be expressed as a limit of quantitation for which all values are less than 10 ppb. A typical ion chromatogram for the most abundant ion of chloroform, m/z 83, is shown in FIG. 5 for aqueous solutions of pure chloroform with different concentration. Note also that very conservative data are given in Table I.

Figure 6:
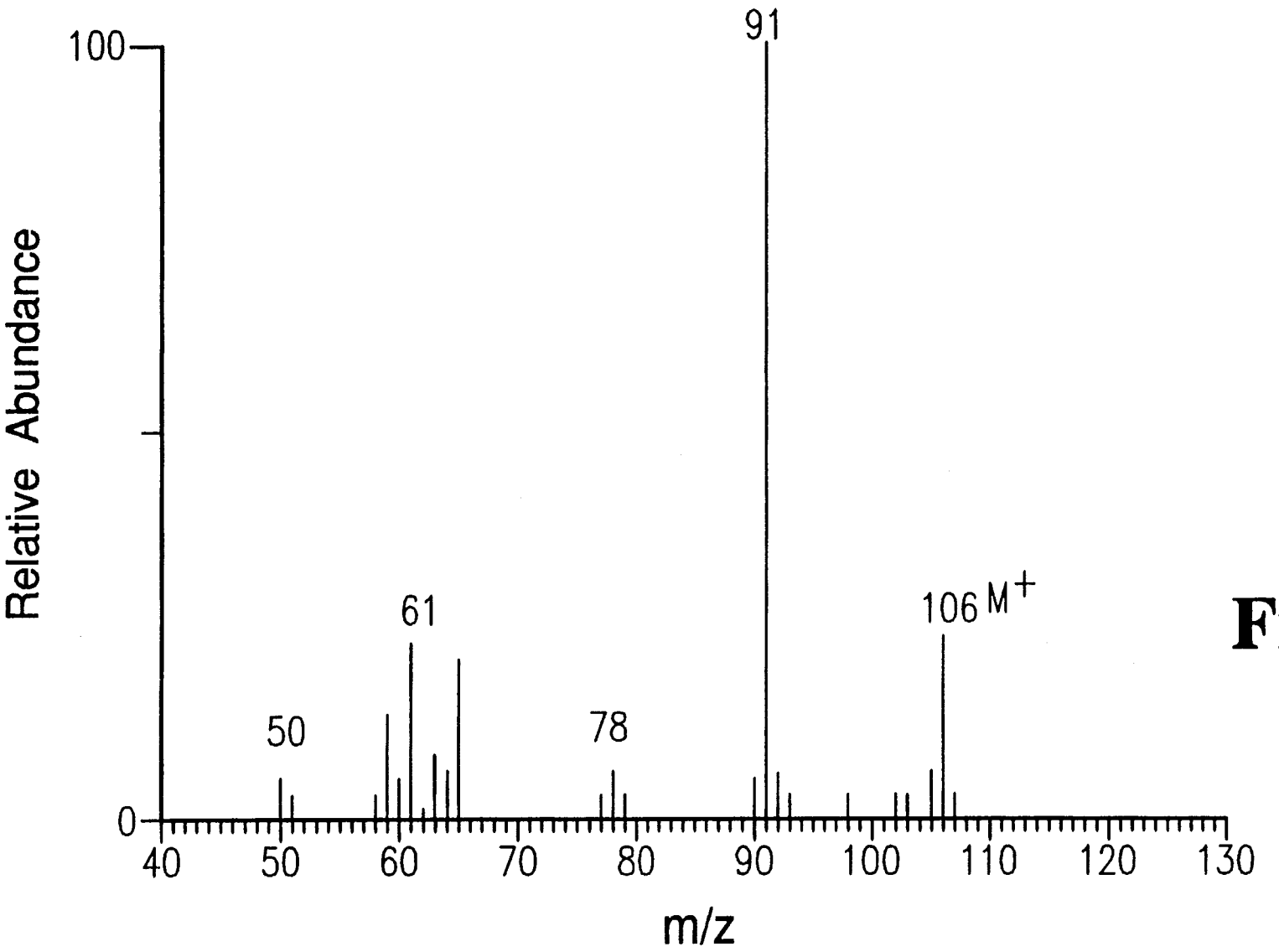
FIG. 6 is a background-subtracted ion trap mass spectrum of 133 parts per trillion (ppt) aqueous solution of ethylbenzene recorded using a direct insertion membrane probe on an ion trap mass spectrometer, as further described in the Experimental.

For example, FIG. 6 shows a mass spectrum recorded for a solution of 133 ppt of ethylbenzene. Note the high quality of this spectrum even though the analyte concentration is below the 1 ppb detection limit given for the mixture in Table I.

TABLE I

Molecular Weights, Abundant Ions and Detection Limits of Volatile Organic Compounds in DIMP Ion Trap Experiment

| Chemical Compounds | MW[a] | Abundant Positive Ions, m/z | Detection limit, (ppb, S/N = 3) |
|---|---|---|---|
| chloromethane | 50 | 50 | 1 |
| vinyl chloride | 62 | 62, 64 | 0.5 |
| chloroethane | 64 | 64, 66 | 2 |
| benzene | 78 | 78 | 0.5 |
| methylene chloride | 84 | 49, 51, 84, 46 | 1 |
| toluene | 92 | 91, 92 | 0.5 |
| bromomethane | 94 | 94, 96 | 1 |
| 1,1-dichloroethene | 96 | 61, 63, 96, 98, 100 | 1 |
| trans-1,2 dichloroethene | 96 | 61, 63, 96, 98, 100 | 1 |
| 1,1-dichloroethane | 98 | 62, 64 | 0.5 |
| 1,2-dichloroethane | 98 | 62, 64 | 1 |
| 2-chloroethylvinylether | 106 | 63, 65 | 2 |
| ethylbenzene | 106 | 91, 106 | 1 |
| trans-1,3-dichloropropene | 110 | 75, 77 | 0.5 |
| cis-1,3-dichloropropene | 110 | 75, 77 | 0.5 |
| 1,2-dichloropropane | 112 | 62, 63, 64, 65, 77 | 0.5 |
| chlorobenzene | 112 | 77, 112, 114 | 0.5 |
| trichloromethane | 118 | 83, 85, 87 | 0.5 |
| trichloroethene | 130 | 95, 97, 99, 130, 132, 134 | 1 |
| 1,1,1 trichloroethane | 132 | 97, 99, 101, 117, 119, 121 | 2 |
| 1,1,2-trichloroethane | 132 | 83, 85, 87, 97, 99, 101 | 2 |
| trichlorofluoromethane | 136 | 101, 103, 105 | 2 |
| tetrachloromethane | 152 | 117, 119, 121 | 2 |
| bromodichloromethane | 162 | 83, 85, 87, 127, 129 | 1 |
| tetrachloroethene | 164 | 129, 131, 133 | 1 |
| 1,1,2,2-tetrachloroethane | 166 | 83, 85, 87 | 2 |
| dibromochloromethane | 206 | 127, 129, 131 | 1 |
| tribromomethane | 250 | 171, 173, 175, 252, 254 | 1 |

[a]) based on the most abundant isotope of each element

Comparison of DIMP and Membrane/Jet Separator

Figure 7:
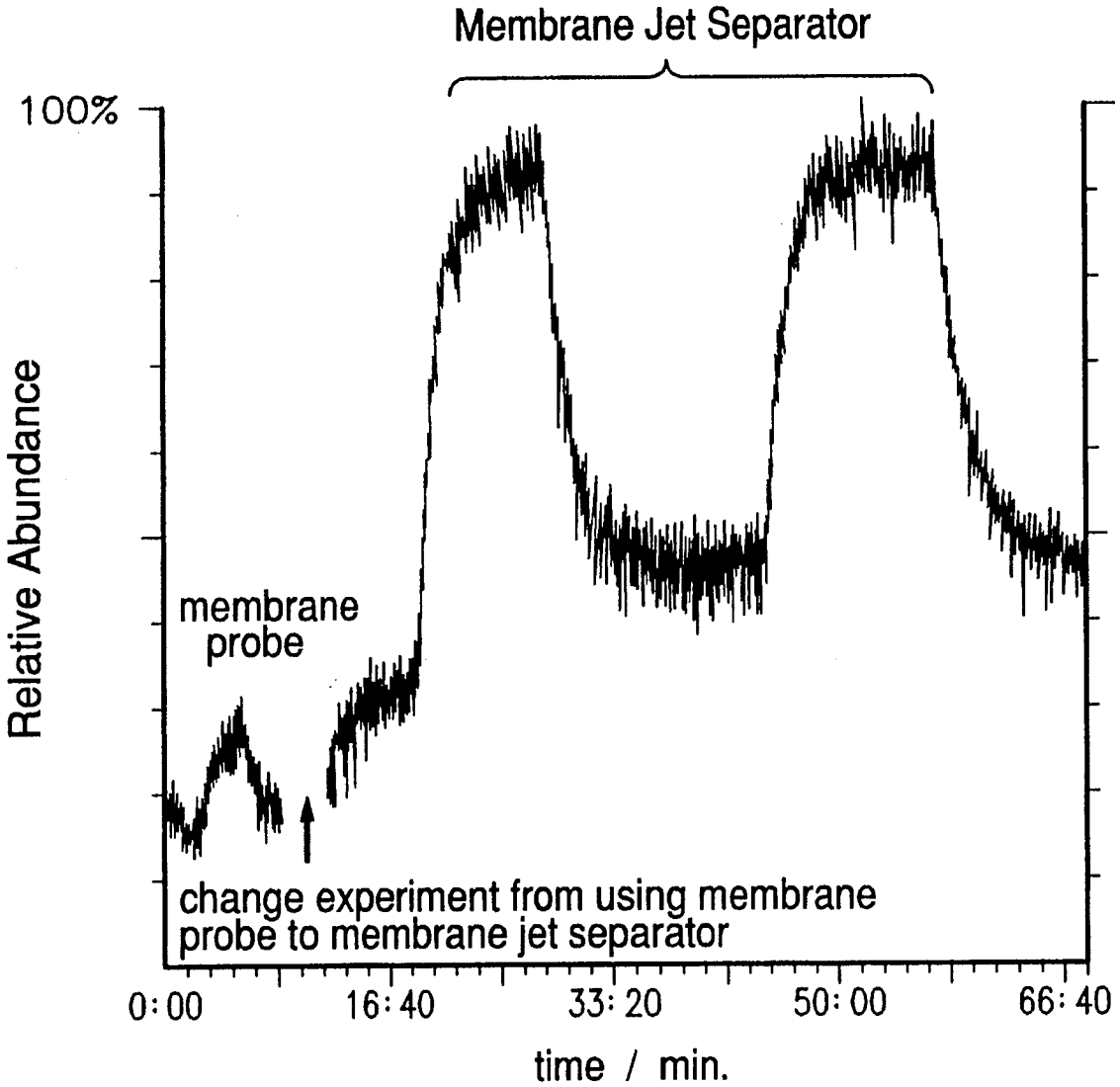
FIG. 7 shows the relative abundance of m/z 83 for aqueous solutions of chloroform at 10 ppb using respectively the direct membrane insertion probe and a membrane/quartz jet separator interfaced to a GC/MS ion trap mass spectrometer, as further discussed in the Experimental.

The performance of the pneumatically-assisted coaxial membrane/jet separator installed on the instrument was compared to that of the DIMP technique using the ion trap mass spectrometer. This was done by examining aqueous solutions in the low ppb concentration range. Some of these comparisons were made with both the hollow fiber direct insertion membrane probe and the pneumatically-assisted coaxial membrane/jet separator installed on the instrument. The ion abundance, e.g. for m/z 83 which is diagnostic of chloroform, was typically several times greater when using the coaxial membrane/jet separator than that given by the direct insertion membrane probe, as shown in FIG. 7.

Analytical Results Using the Membrane/Jet Separator System

Figure 8:
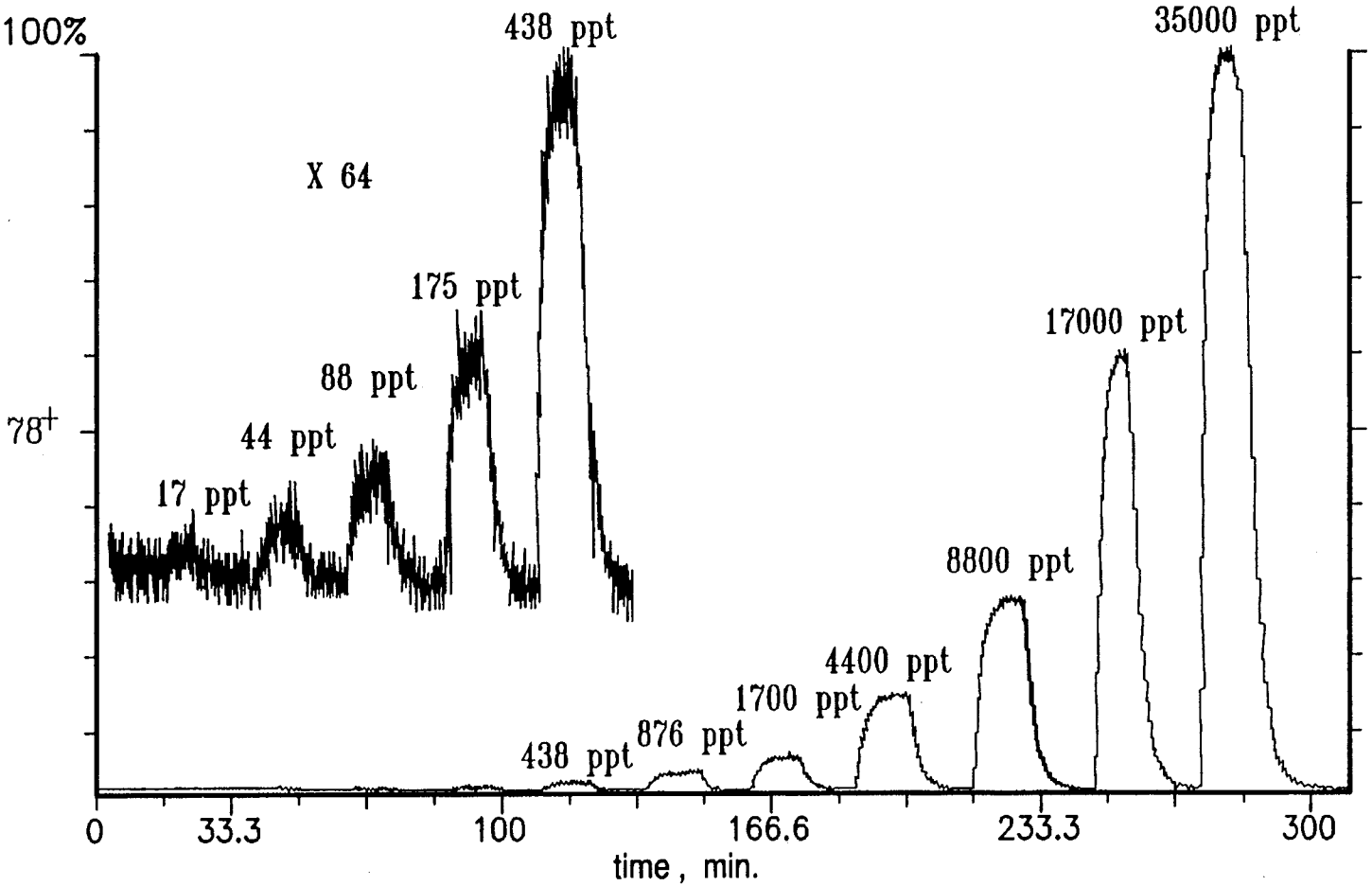
FIG. 8 is an ion chromatogram (m/z 78) for aqueous solutions of benzene at concentrations from 17 to 35000 ppt. The solutions were passed sequentially through the membrane/jet separator system on a quadrupole ion trap mass spectrometer, as described in the Experimental.
Figure 9:
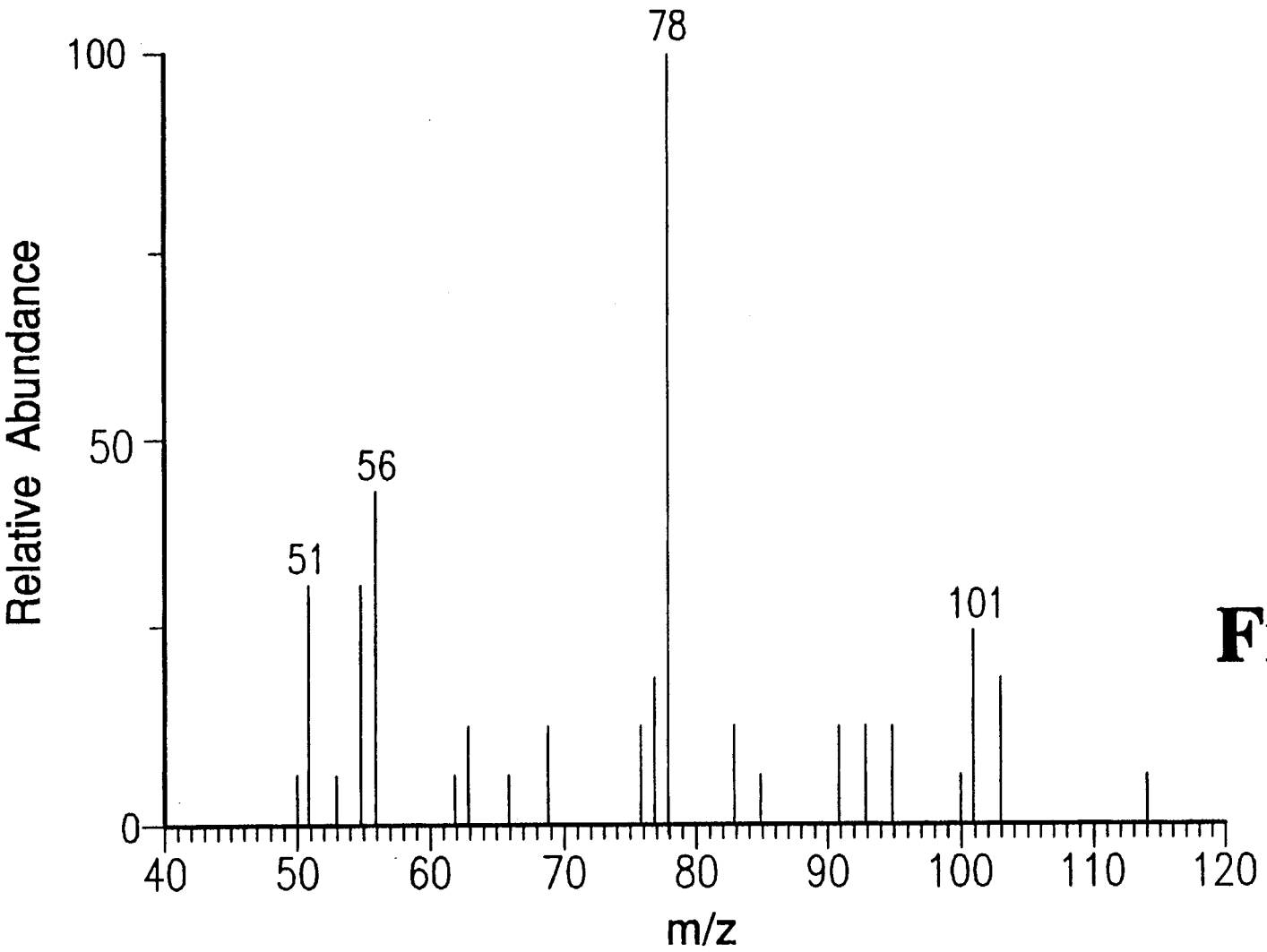
FIG. 9 is a mass spectrum of a 88 ppt benzene solution recorded using the pneumatically-assisted coaxial membrane/jet separator interfaced to an ion trap mass spectrometer, as further described in the Experimental.
Figure 10:
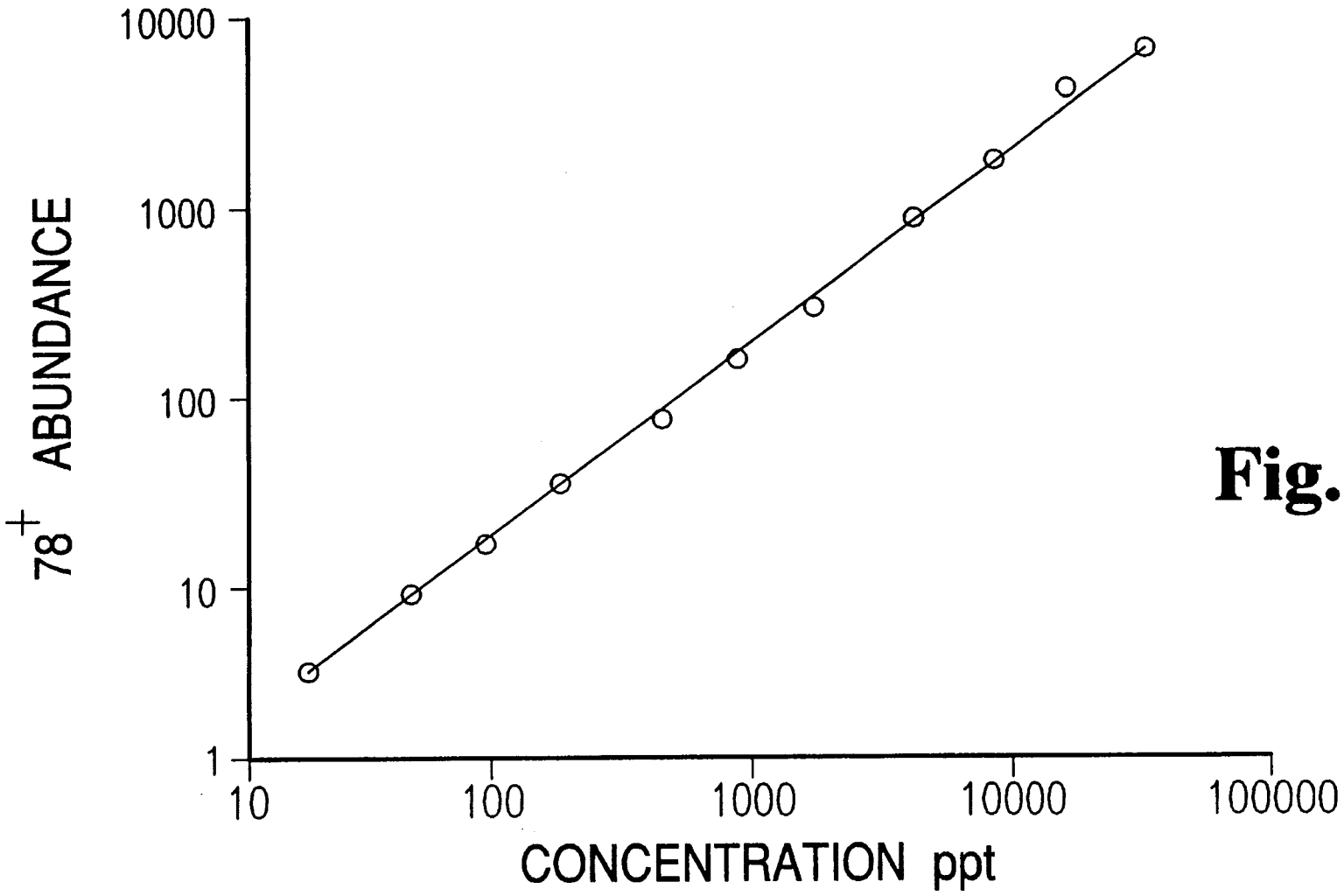
FIG. 10 shows the ion abundance of m/z 78 vs. concentration of benzene solution in ppt.
Figure 11:
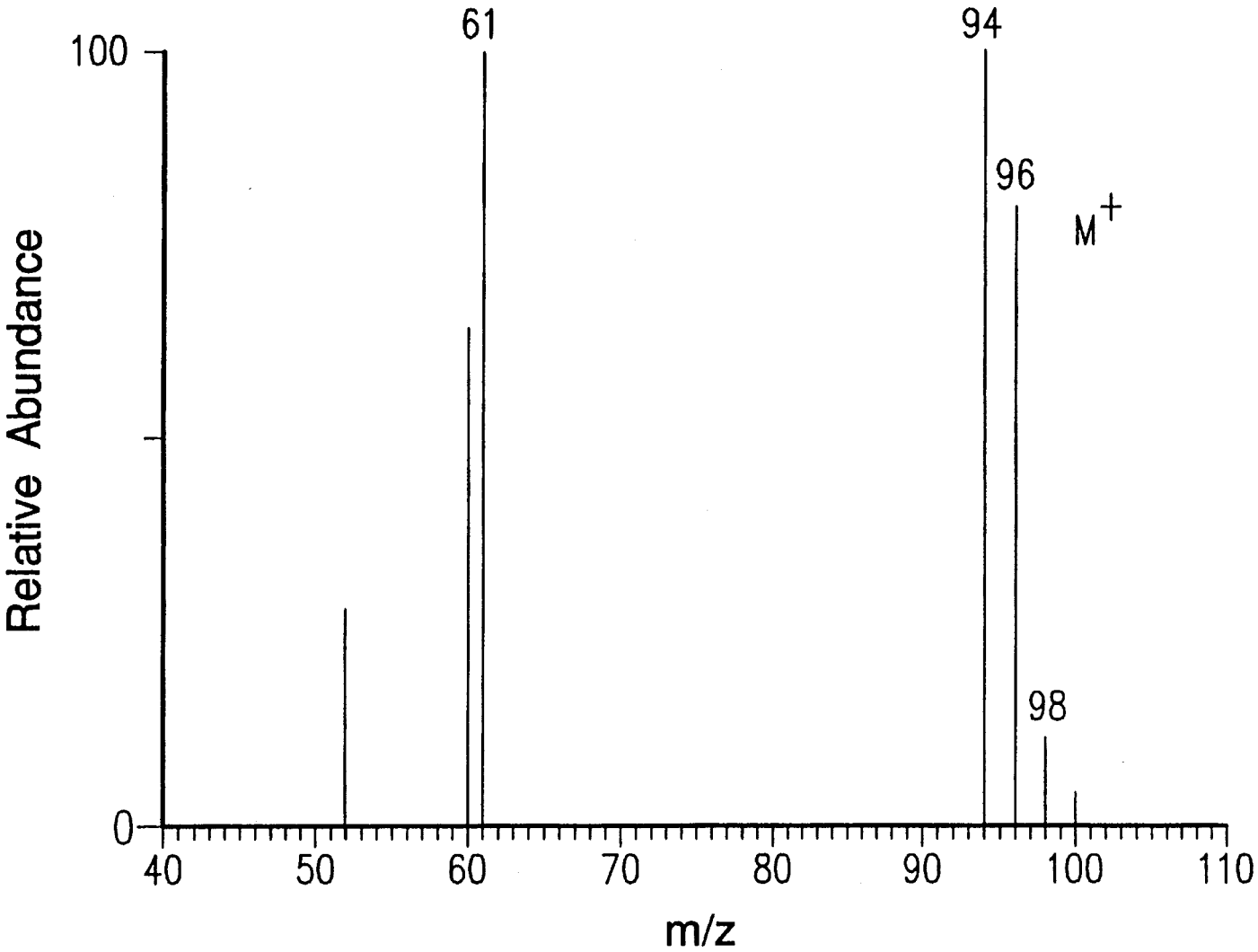
FIG. 11 shows the mass spectrum of a solution of 627 ppt trans-dichloroethane recorded using the coaxial membrane/jet separator ion trap system at 70° C., as further described in the Experimental.

The coaxial membrane/jet separator was used to examine aqueous solutions of benzene of varying concentration and the ion chromatograms for m/z 78 are shown in FIG. 8. The response times are several minutes but decrease with increasing membrane temperature. The mass spectrum of the 88 ppt benzene solution is dominated by m/z 78 (FIG. 9). The linearity of response over a wide dynamic range is illustrated in FIG. 10. Using this membrane/jet separator system, the detection limits for benzene, trans-dichloroethylene, and chlorobenzene are all approximately 30 parts per trillion or less, viz. limits of quantitation of approximately 100 ppt or less. Several more polar compound were also examined including propanol and 2-butanone; detection limits were less than 100 ppb at ambient temperature. The effect of membrane temperature was investigated using both trans-dichlorethane, benzene and acetic acid. The more polar acetic acid (detection limit 50 ppb at ambient temperature) showed a significant increase in signal with increasing temperature. On the other hand, comparable signals were observed for a 627 ppt solution of trans-dichlorethane over the temperature range of 22 to 70° C. Higher flow rates had a favorable effect at the higher temperature where analyte loss by evaporation may be a factor. Typical of these data is the mass spectrum shown in FIG. 11 which was recorded at 70° C.

C. Single Quadrupole Experiment

In this work, the metal jet separator illustrated in FIG. 3 was used in trace level analysis, and experiments to optimize the distance between the tops of the delivery and receiving capillary of the metal jet separator were performed.

Characterization of the Metal Jet Separator

Figure 12:
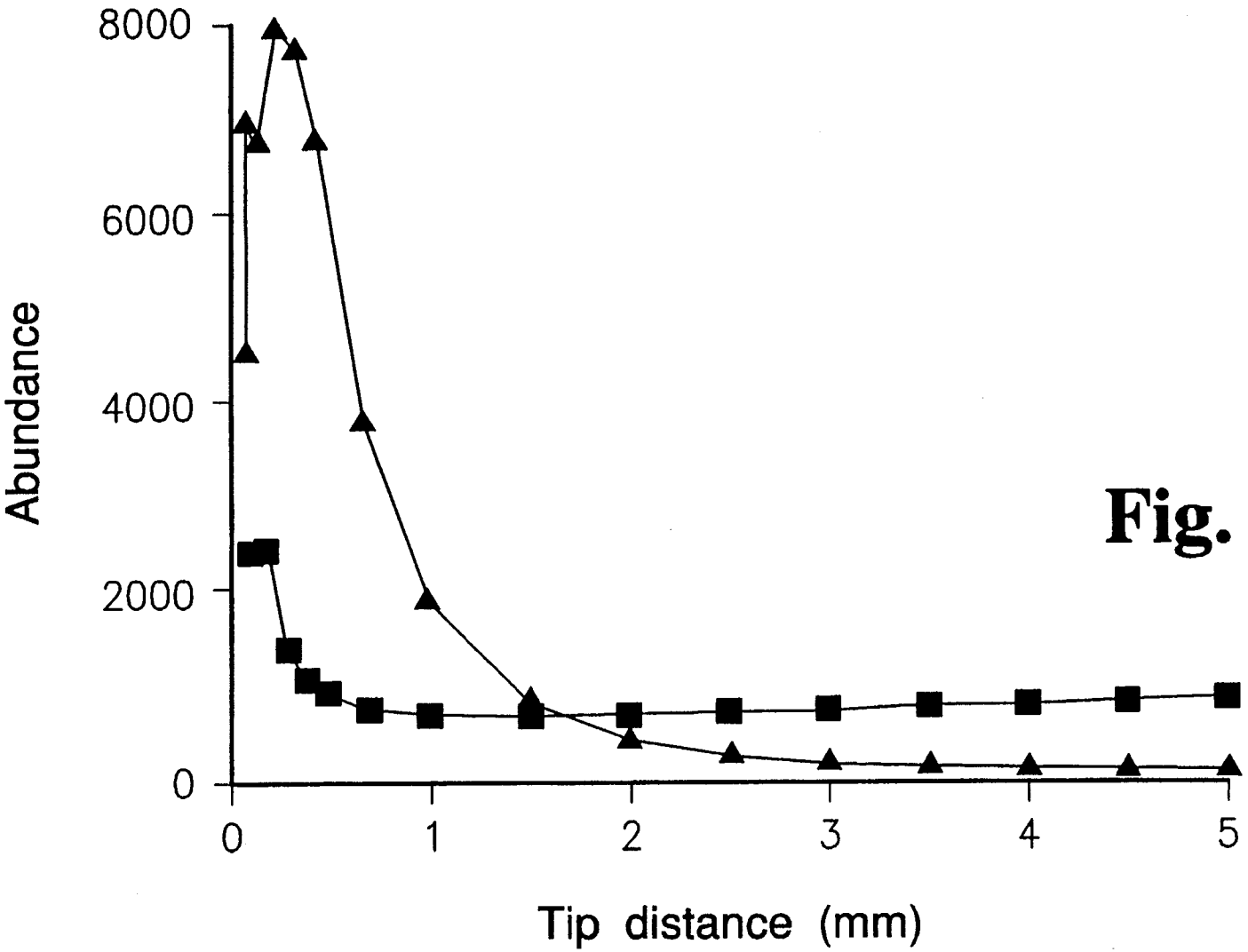
FIG. 12 shows the relative abundance of m/z 83 for chloroform (▲) and m/z 4 for helium (■) as a function of the tip distance in the metal jet separator of FIG. 3 using a helium flow rate of 25 mL/min. The pneumatically-assisted coaxial membrane/metal jet separator was interfaced to a single quadrupole mass spectrometer, as further described in the Experimental.

FIG. 12 shows the results of varying the distance between the delivery and the receiving tips of the jet separator. In this experiment, the exterior of the silicone membrane was flushed with a solution of 250 ppm chloroform in distilled water and a helium flow of 25 mL/min was used to transport chloroform through the interior of the membrane to the jet separator and finally to the ion source of the quadrupole mass spectrometer. The relatively high concentration of chloroform was necessary in order to measure chloroform and helium simultaneously using a Faraday cup. At tip distances greater than 3 mm both the chloroform (m/z 83) and the helium (m/z 4) signals are unaffected by changes in capillary tips spacing. The helium signal remains constant at a spacing of about 1 mm and increases at smaller spacing down to 0.12 mm. Pressures in both the expansion chamber and the mass spectrometer were recorded during the experiment. Pressure in the expansion chamber was constant at 0.59 mbar during the experiment, whereas the high vacuum pressure (uncalibrated) increased slowly from $5\times10^{-7}$ mbar at 3 mm to $2\times10^{-6}$ at a 0.7 mm capillary spacing and then increased rapidly to $2\times10^{-4}$ mbar at 0.12 mm.

The calculated ratio of the signal intensities due to chloroform and helium at every spacing between the capillary tips was measured and found to increase from 0.14 at tip spacings larger than 3 mm to a maximum ratio of 7.0 at spacing of 0.5 and 0.4 mm. At spacings shorter than 0.4 mm, the ratio decreased. This result is in good agreement with earlier studies of jet-separators by Stern et al. (*J. Phys. Chem.*, 1960, 33, 805) where an optimal spacing was observed for maximum enrichment for a given helium flow rate. In the inventive experiments, the observed maximum signal of the analyte and not the value of the ratio of the analyte to helium is important. Using this criterion, the optimum distance between the capillary tips was found to be 0.30 mm in these experiments, a value which is smaller than the optimum distance for maximum enrichment. Since most of the compounds tested gave a maximum signal at 0.30 mm, this spacing was used in the measurements of the detection limits.

Anaytical Results Using the Membrane/jet Separator System

Figure 13A:
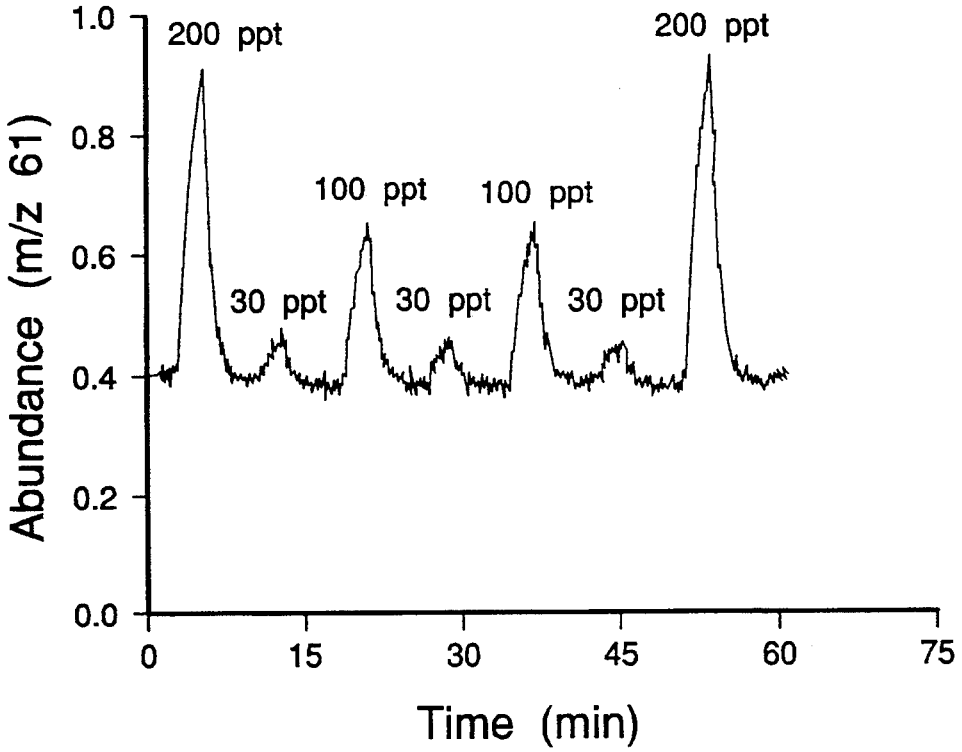
FIG. 13 shows single ion monitoring during successive injections of solutions of various concentrations a) trans-dichlooethylene, m/z 61 monitored and b) benzene, m/z 78 monitored. The pneumatically assisted coaxial membrane/metal jet separator was interfaced to the single quadrupole mass spectrometer, as described in the Experimental.
Figure 13B:
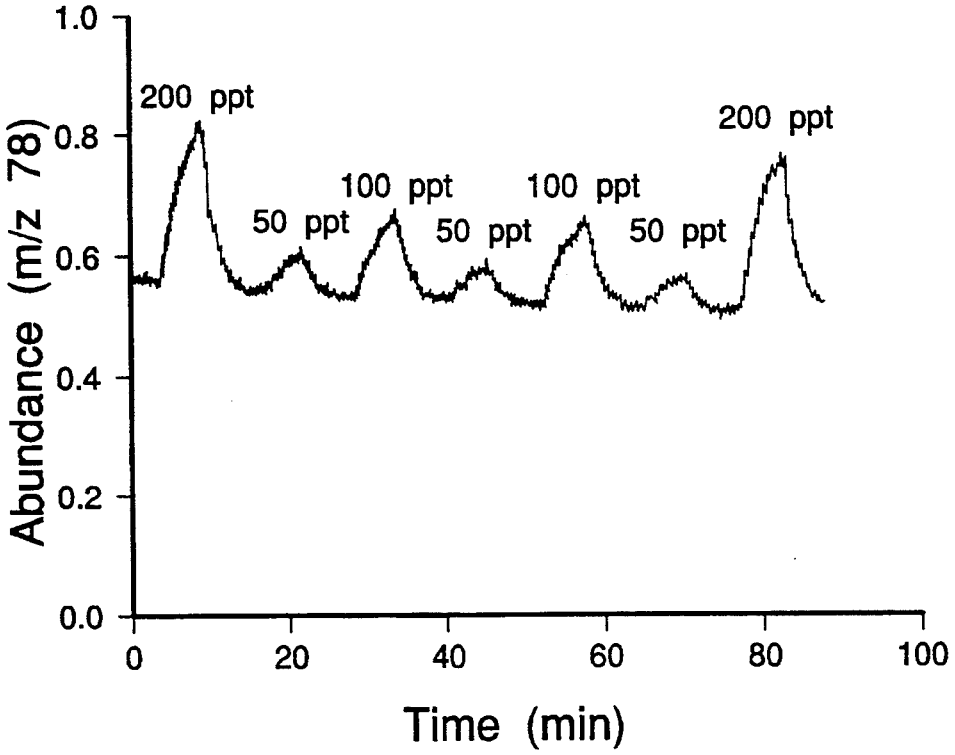

The metal jet separator was used with a silicone membrane in the pneumatically-assisted configuration. The quadrupole instrument was operated in the single-ion monitoring mode and the results obtained for trans-dichloroethane (m/z 61) and benzene (m/z 78) at concentrations in the parts per trillion range are shown in FIG. 13. The concentration dependence, reproducibility of the signals and the signal to noise ratios are all excellent.

Figure 14:
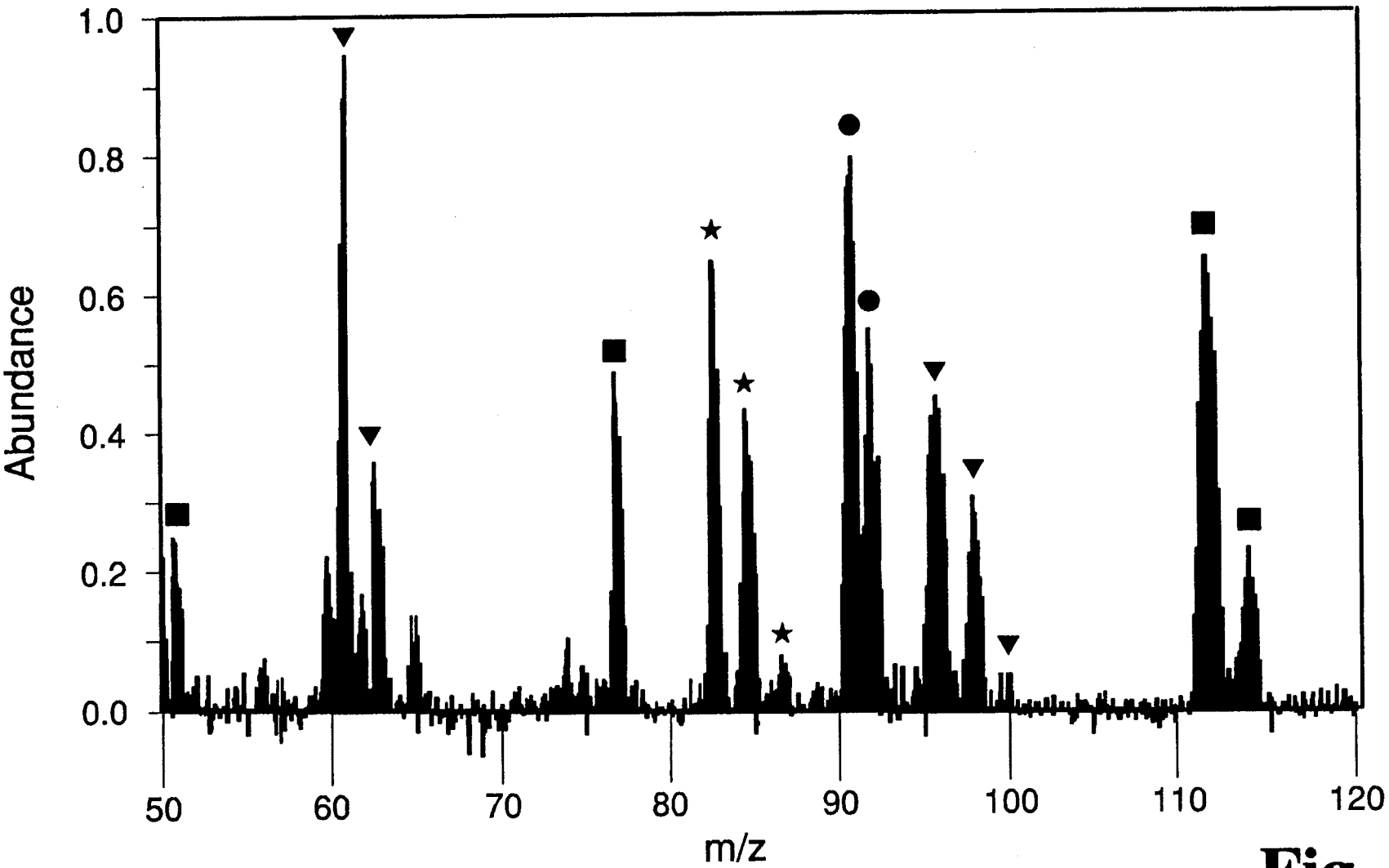
FIG. 14 shows a background-subtracted mass spectrum of a mixture containing (▼) trans-dichloroethylene, (★) chloroform, (■) chlorobenzene and (●) toluene each at 1 ppb. The pneumatically assisted coaxial membrane/metal jet separator was interfaced to the single quadrupole mass spectrometer, as described in the Experimental.
Figure 15:
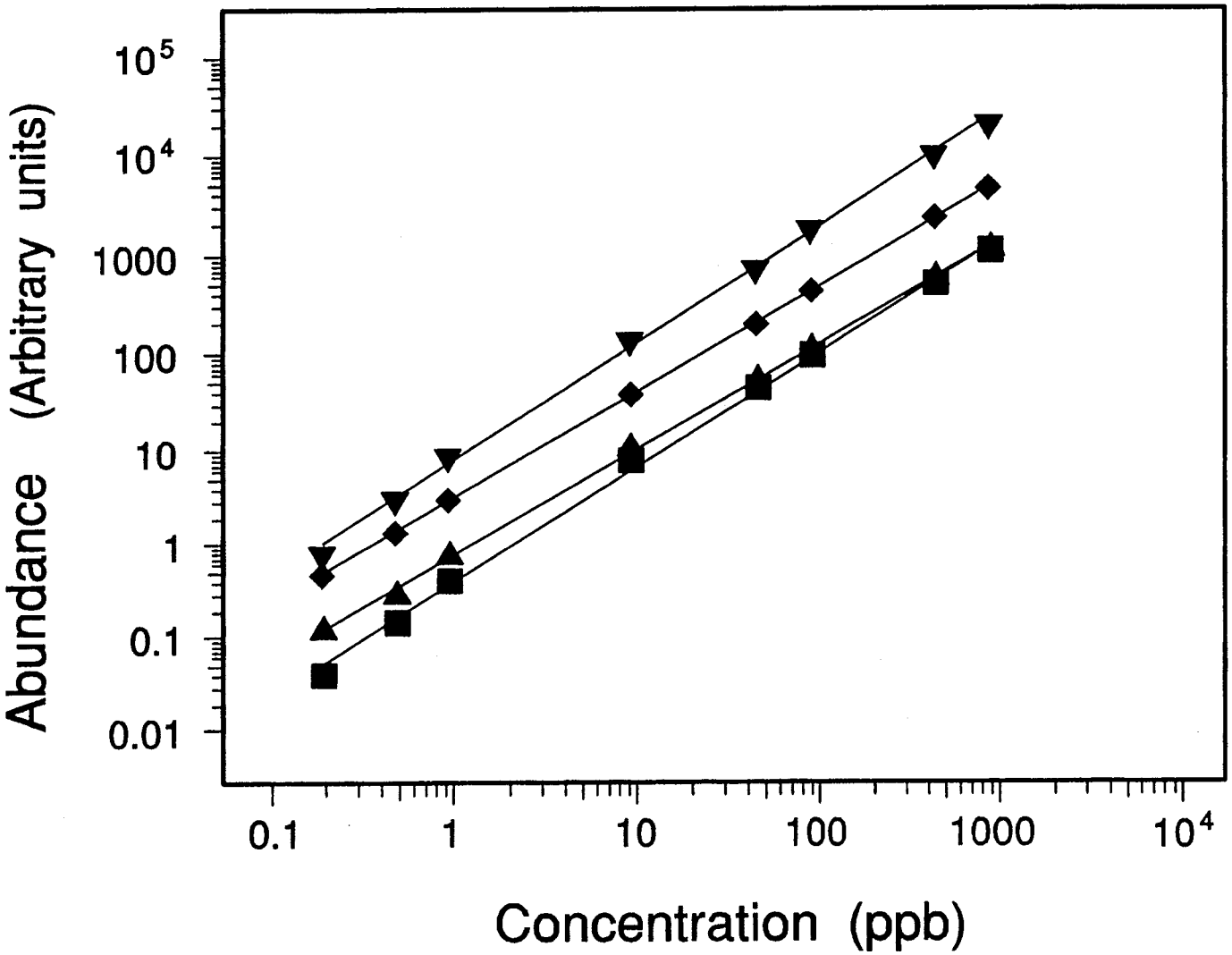
FIG. 15 shows linearity of response of chloroform (▲), toluene (▼), trans-dichloroethylene (◆), chlorobenzene (■). Experiments were conducted in the single quadrupole mass spectrometer using the membrane/-metal jet separator system, as described in the Experimental.

Actual sample solutions may contain single or multiple analytes. For identification of the analytes, the full mass spectrum of the analytes is desired. In order to test the system with a multicomponent solution, a mixture of several chlorinated volatile organic analytes was prepared. The mixture includes trans-dichloroethane, chloroform, chlorobenzene and toluene, each at 1 ppb. The quadrupole mass spectrometer was set to record full scan spectra (from 45 Da/charge to 120 Da/charge). The experimental parameters were as described above and the result is shown in FIG. 14. The ions characteristic of each component can be identified readily. The identification process can be confirmed by standard addition experiments. In addition to being complex mixtures, actual samples may contain analytes present at greatly different concentrations. Using a mixture of the same compounds indicated above, a series of solutions with different concentrations were prepared. FIG. 15 shows the result of one experiment. A linear relationship is observed for all of the components in the solution, from the low parts per trillion level to 1000 ppb. These results indicate that a linear dynamic range of at least 2 orders of magnitude is possible for this system, even when complex mixtures are examined.

Detection limits (single ion monitoring) were determined for some specific compounds, as listed in Table II. For none of the more volatile compounds does the detection limit exceed 300 ppt. Particularly noteworthy is the data for trans-dichloroethane where the detection limit is 30 ppt.

The less volatile, more polar compounds showed higher detection limits as expected because of the hydrophobic nature of the membrane used. For example, acetic acid gave a detection limit of just 5 ppm and even a compound like acetone gave a detection limit of 20 ppb at the 45° C. temperature chosen for these experiments.

TABLE II

Detection Limits of Volatile Organic Compounds Using Membrane/Metal Jet Separator in a Quadrupole Mass Spectrometer

| Chemical Compounds | MW[a] | Ions Monitored, m/z | Detection limit, (ppb, S/N = 3) |
|---|---|---|---|
| benzene | 78 | 78 | 0.050 |
| toluene | 92 | 91 | 0.090 |
| trans-1,2 dichloroethene | 96 | 61 | 0.030 |
| chlorobenzene | 112 | 112 | 0.100 |
| trichloromethane | 118 | 83 | 0.300 |
| tetrachloromethane | 152 | 119 | 0.200 |

[a]) based on the most abundant isotope of each element

Additional Experiments Using Sheet Membrane/Jet Separator Apparatus

Figure 16:
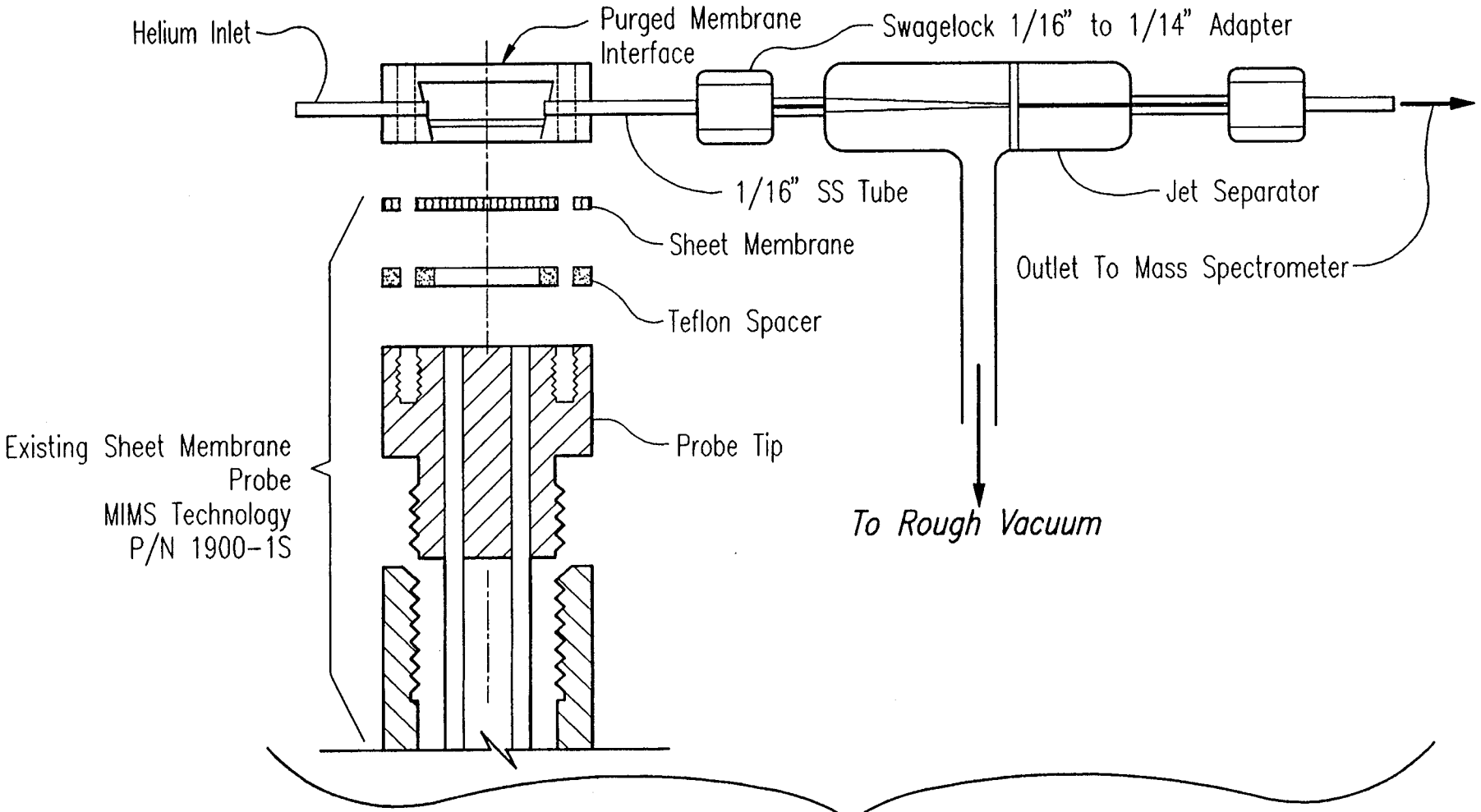
FIG. 16 provides a schematic diagram of a sheet membrane device/jet separator apparatus of the invention as further described in the Experimental.

In other experiments, a sheet membrane unit was constructed as detailed in FIG. 16. A sheet membrane direct insertion probe, available from MIMS Technology Development, Inc., West Lafayette, Ind., was modified to construct the sheet membrane unit. In particular, the probe tip cap was replaced by a sealed cap that incorporated a helium inlet and and outlet line (1/16" stainless steel (SS) tube) to provide gas flow across the vacuum side of the membrane and carry the analyte molecules to the jet separator (a 1/16" to 1/14" swagelock adaptor was used to connect the helium outlet of the sealed cap and the inlet to the jet separator), as shown in FIG. 16. The outlet of the jet separator was in turn connected to the mass spectrometer as illustrated. The sheet membrane was placed on the end of the probe and sealed in place with the modified tip cap which was retained with 6 #1 internal wrenching screws as used in the stock probe. Using other conditions and attachments as described in connection with the capillary membrane unit above, the sheet membrane unit was evaluated, and similar advantageous results were obtained.

All publications cited herein are indicative of the level of ordinary skill in the art and are hereby incorporated by reference as if each had been individually incorporated by reference and fully set forth.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for treating a sample for introduction into a mass spectrometer, comprising:

a membrane separator device adapted to treat a crude analyte-containing sample to selectively pass the analyte through a membrane to form a first conditioned sample enriched in the analyte relative to the crude sample;

a jet separator device fluidly coupled to the membrane separator device to receive said first conditioned sample, and adapted to treat the first conditioned sample to form a second conditioned sample enriched in the analyte relative to the first conditioned sample.

2. The device of claim 1, wherein said membrane separator device comprises a tubular membrane.

3. The device of claim 1, wherein said membrane separator device comprises a sheet membrane.

4. A method for treating a crude analyte-containing sample for introduction into a mass spectrometer, comprising:

treating said crude sample with a membrane separator device to pass the analyte through a membrane so as to form a first conditioned sample enriched in the analyte relative to the crude sample; and treating said first conditioned sample with a jet separator device so as to form a second conditioned sample enriched in the analyte relative to the first conditioned sample.

5. An analytical apparatus, comprising:

a membrane separator device adapted to treat a crude analyte-containing sample to pass the analyte through a membrane to form a first conditioned sample enriched in the analyte relative to the crude sample;

a jet separator device fluidly coupled to the membrane separator to receive said first conditioned sample, and adapted to treat the first conditioned sample to form a second conditioned sample enriched in the analyte relative to the first conditioned sample; a a mass spectrometer having a sample input fluidly coupled to said jet separator device so as to receive said second conditioned sample for analysis.

6. The apparatus of claim 7, wherein said membrane device comprises a tubular membrane.

7. The apparatus of claim 5, wherein said membrane separator device comprises a sheet membrane.

8. A device for treating a crude sample having an analyte contained in a liquid, comprising:

a membrane separator device comprising a membrane against which the sample can be passed so as to selectively pass the analyte through the membrane and thus create a first conditioned sample enriched in the analyte relative to the crude sample; and a jet separator device comprising a sample delivery tube and a sample receiving tube separated by a gap and housed within a chamber adapted to be evacuated, said sample delivery tube being fluidly coupled to said membrane separator to receive said first conditioned sample, so that passage of said first conditioned sample through said delivery tube, across said gap and into said receiving tube forms a second conditioned sample enriched in the analyte relative to the first sample.

9. The device of claim 8, wherein said membrane is a tubular membrane.

10. The device of claim 8, wherein said membrane is a sheet membrane.

11. The device of claim 8, wherein said jet separator device is adapted so as to allow variation in the width of said gap.

12. The device of claim 8, wherein said jet separator device is heated.

13. The device of claim 11, wherein said membrane is a tubular membrane.

14. The device of claim 12, wherein said membrane is a tubular membrane.

* * * * *

UNITED STATES PATENT AND TRADEMARK OFFICE

CERTIFICATE OF CORRECTION

PATENT NO. : 5,448,062

DATED : September 5, 1995

INVENTOR(S) : Robert Graham Cooks, et. al.

It is certified that error appears in the above-indentified patent and that said Letters Patent is hereby corrected as shown below:

Title page, item [75], inventors: should read as following--

Robert G. Cooks; Scott J. Bauer, both of West Lafayette, Tapio Kotiaho, of Espoo, FINLAND, Lindy Dejarme, of Columbus, Ohio, and Frants Lauritsen, of Odense, DENMARK.

Signed and Sealed this

First Day of July, 1997

Bruce Lehman

*Attest:*

BRUCE LEHMAN

*Attesting Officer*

*Commissioner of Patents and Trademarks*